US007364500B2

(12) United States Patent
Brown

(10) Patent No.: US 7,364,500 B2
(45) Date of Patent: Apr. 29, 2008

(54) SANDING APPARATUS AND METHOD OF MANUFACTURE

(76) Inventor: John E. Brown, 3938 7 th Ave., Anoka, MN (US) 55303

( * ) Notice: Subject to any disclaimer, the term of this patent is extended or adjusted under 35 U.S.C. 154(b) by 118 days.

(21) Appl. No.: 11/365,351

(22) Filed: Mar. 1, 2006

(65) Prior Publication Data

US 2006/0199484 A1 Sep. 7, 2006

Related U.S. Application Data

(60) Provisional application No. 60/679,472, filed on May 10, 2005, provisional application No. 60/666,811, filed on Mar. 31, 2005, provisional application No. 60/657,461, filed on Mar. 1, 2005.

(51) Int. Cl.
*B24D 15/00* (2006.01)

(52) U.S. Cl. ..... 451/523; 451/525; 451/456; 451/354; 451/527

(58) Field of Classification Search ..... 451/354, 451/523, 524, 525, 456, 356
See application file for complete search history.

(56) References Cited

U.S. PATENT DOCUMENTS 3,793,781 A * 2/1974 Hutchins ..... 451/356
4,549,371 A * 10/1985 Hakoda ..... 451/456
4,759,155 A * 7/1988 Shaw ..... 451/524
4,964,243 A * 10/1990 Reiter ..... 451/354
5,283,988 A * 2/1994 Brown ..... 451/524
5,624,305 A * 4/1997 Brown ..... 451/354
6,620,031 B2 * 9/2003 Renteln ..... 451/41
7,112,127 B2 * 9/2006 Watson ..... 451/356
2001/0008829 A1 * 7/2001 Ueno ..... 451/523
2003/0087596 A1 * 5/2003 Pellegrin ..... 451/354
2005/0124272 A1 * 6/2005 Watson ..... 451/356

* cited by examiner

*Primary Examiner*—Eileen P. Morgan
(74) *Attorney, Agent, or Firm*—Altera Law Group, LLC

(57) ABSTRACT

An improved resilient sanding block of the type comprising a core having a plurality of exterior surfaces, including a first major surface and a second major surface and side surfaces, and having a layer of abrasive material disposed thereon. The resilient sanding block may have one or more apertures or through holes extending from one major surface to the other major surface and channels formed in at least one of the major surfaces, with the channels in communication with the aperture. When a vacuum source is operatively connected to the aperture, the dust created by sanding will be substantially removed into the vacuum source via the channels and the aperture. A holder for a resilient sanding block is also disclosed, as well as a handle for the holder, which together form a sanding system.

16 Claims, 12 Drawing Sheets

SANDING APPARATUS AND METHOD OF MANUFACTURE

CROSS-REFERENCE TO RELATED APPLICATIONS

This application claims benefit to a provisional application No. 60/657,461 filed on Mar. 1, 2005, which is hereby incorporated by reference, and to provisional application No. 60/666,811 filed Mar. 31, 2005 and provisional application No. 60/679,472 filed May 10, 2005.

BACKGROUND OF THE INVENTION

1. Field of the Invention

The present invention relates generally to surface finishing tools. Particularly, the present invention relates to flexible sanding tools. More particularly, the present invention relates to resilient sanding blocks that can be used in conjunction with a holder to improve the user's grip and which can be used in conjunction with components of existing surface finishers to form a dustless sanding system.

2. Description of the Related Art

Dustless sanding tools and dustless sanding have been known and practiced in the construction trades for a number of years. Known dustless sanding tools comprise a handle that connects to a vacuum source, and a sanding element, such as a sanding screen, which attaches to the bottom surface of the tool by means of clamping mechanisms. Such bottom surfaces are provided with through holes or grooves that are in communication with the vacuum source, and over which the sanding screen is positioned. In operation, dust is sucked through apertures in the screen and the grooves or through holes and is deposited into a collection receptacle.

Such dustless sanding tools have many disadvantages. They are not useful for small jobs, or jobs that have a limited amount of space in which to operate. They are not economical, especially for small jobs, because the user must purchase a hand held tool as well as an abrasive sanding screen, which are not inexpensive. Additionally, existing dustless sanding tools are designed to work only in a reciprocating motion and often, the suction force developed by the vacuum causes the sander to be clamped to the surface being sanded. Another drawback is that the bottom surface is made from relatively rigid material such as plastic or hard rubber. This makes it difficult, if not impossible, to sand a curved or undulating surface. Further, the hard bottom commonly leaves relatively deep grooves in drywall that requires subsequent re-finishing. Moreover, these known dustless sanding tools are large, heavy and cumbersome.

There is a need for a sanding tool that has the abrasive material incorporated into the tool itself, rather than requiring an abrasive material be attached to a tool. There is a need for a sanding tool made of a resilient material so the tool that is able to conform to irregular surfaces. There is a need for a sanding tool that is inexpensive to manufacture and disposable. There is a need for a compact and lightweight dustless sanding tool. There is a need for a resilient sanding block that can be used with existing dustless sanding components. And, there is a need for a small, portable, dustless sanding system that can be easily transported about a job site.

SUMMARY OF THE INVENTION

It is an object of the present invention to increase the utility of known sanding tools that may be optionally connected to a vacuum device. The present invention achieves this objective by providing an existing resilient sanding block having a centrally located through hole or aperture and one or more channels located and formed on sanding surfaces of the block. The aperture may be directly connected to a vacuum source or it may be attached to a holder that directs a vacuum source to the sanding surface of the resilient sanding block. The block may be more than one aperture or through holes depending on the particular type of holder that will be used in conjunction with the block.

More specifically, the resilient sanding block has a plurality of surfaces including a first and second major surface. Abrasive material may be disposed on one or both of the major surfaces. The channels on the major surfaces may be formed in a variety of patterns and are generally in communication with the aperture. When a suction force is applied to the aperture, dirt and dust will travel through the channels and then up through the aperture. From there, the dirt and dust will be directed towards the vacuum source and into a collection receptacle. If the resilient block is attached to a holder, the dirt and dust will travel from the channel, through the aperture and into the holder, which will direct the debris toward the vacuum source and into the collection receptacle.

A resilient sanding block of the present invention may be manufactured by taking an existing block with an abrasive material disposed on at least one major surface and forming at least one through hole or aperture between the major surfaces of the block. Channels may then be formed to be in communication with the aperture(s). The resilient sanding block of the present invention may also be manufactured by first forming channels in the major surfaces of the block and then forming a though hole between the major surfaces of the block.

DETAILED DESCRIPTION OF THE PREFERRED EMBODIMENT

Figure 1:
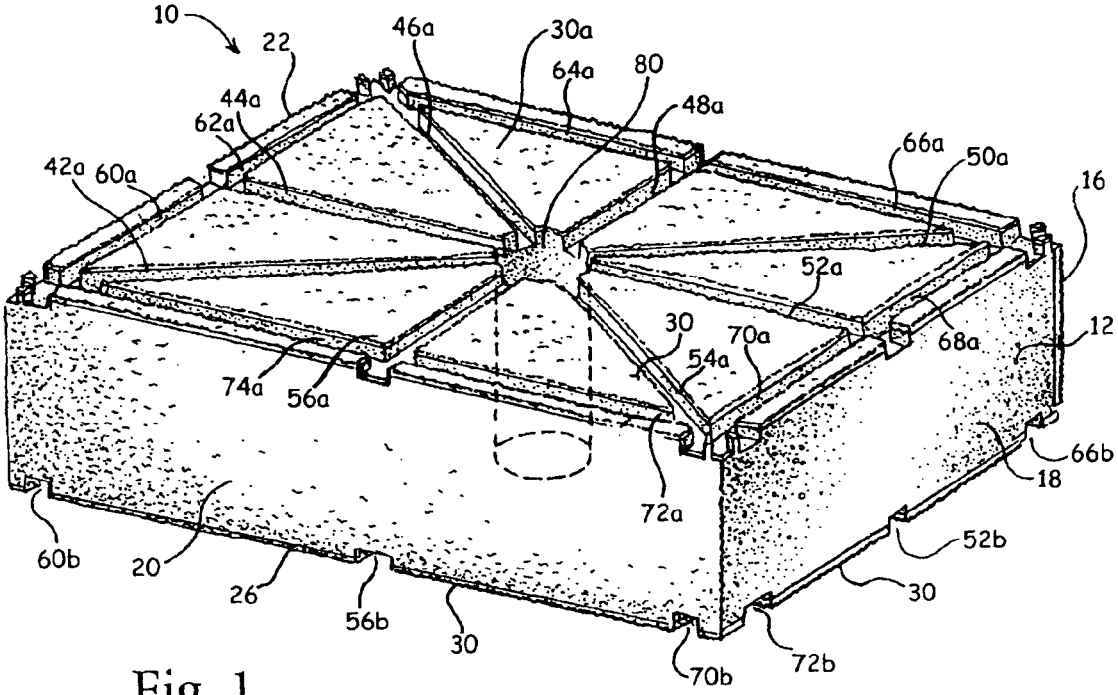
FIG. 1 is a perspective view of one embodiment of the resilient sanding block of the present invention showing a first major material working surface.
Figure 2:
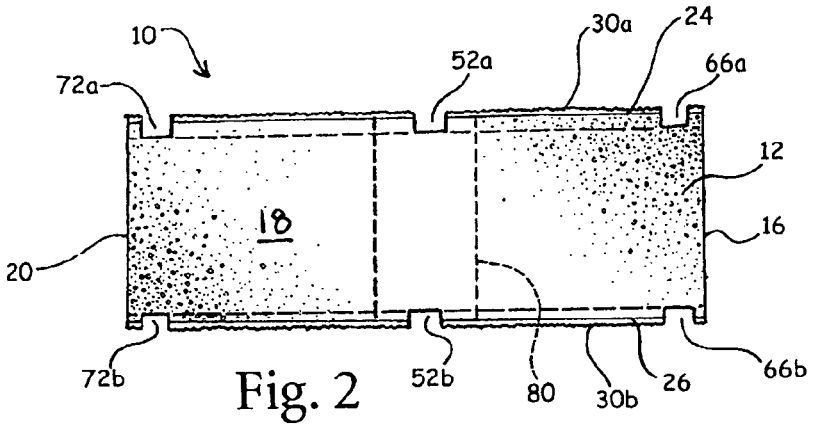
FIG. 2 is side elevational view of the embodiment of FIG. 1.
Figure 3:
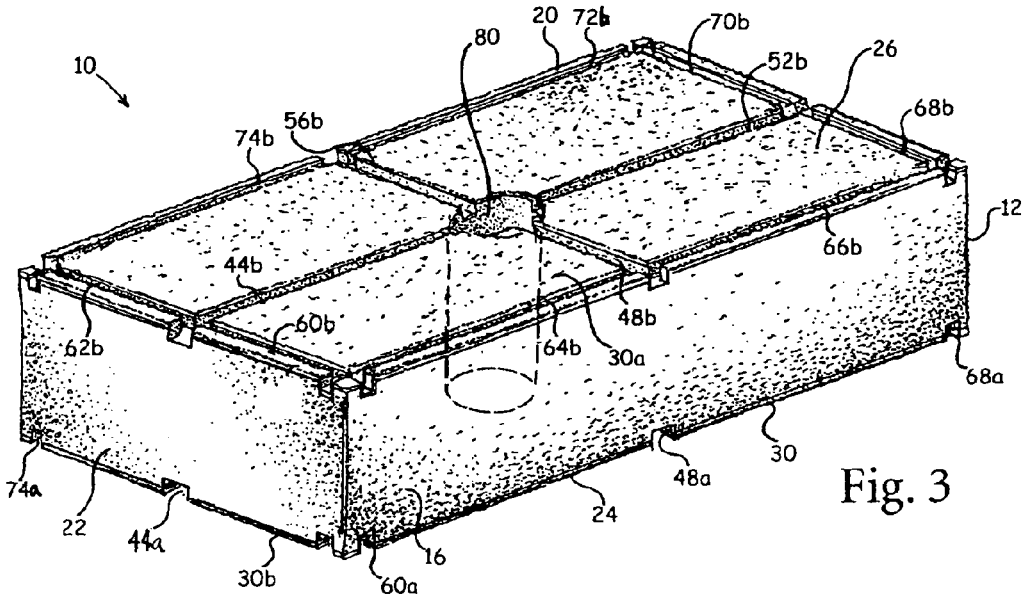
FIG. 3 is an inverted perspective view of the resilient sanding block of FIG. 1 showing a second major material working surface.

The present invention is illustrated in FIGS. 1-25. FIG. 1 shows a perspective view and FIG. 2 shows and end view of the preferred embodiment of the present invention. Generally, the resilient sanding block 10 comprises a core 12, major surfaces 24, 26, side surfaces 16, 20, and end surfaces 18, 22. More specifically, a first major surface 24 is best shown in FIG. 1 and the second major surface 26 is best shown in FIG. 3. The resilient sanding block 10 comprises a core 12 having primary channels 42*a*, 44*a*, 44*b*, 46*a*, 48*a*, 48*b*, 50*a*, 52*a*, 52*b*, 54*a*, 56*a*, and 56*b* that are in communication with an aperture 80. The core 12 further comprises secondary channels 60*a*, 60*b*, 62*a*, 62*b*, 64*a*, 64*b*, 66*a*, 66*b*, 68*a*, 68*b*, 70*a*, 70*b*, 72*a*, 72*b*, 74*a*, and 74*b* that are in communication with the primary channels 42-56. The core 12 is made of a resilient material, preferably polyurethane foam, foam rubber or sponge. However, it will be understood that other materials having similar properties may be used without departing from the sprit and scope of the invention. Preferably, the resilient sanding block 10 has have a height of about 1 to about 5 cm, more preferably about 2 to about 3 cm. In this embodiment, the resilient sanding block 10 has two layers of abrasive material 30*a*, 30*b* disposed on its first and second major surfaces 24, 26, respectively.

In this present embodiment, an aperture or through hole 80 is formed in the resilient sanding block 10 so that it extends through the thickness of the core 12 from the first major surface 24 to the second major surface 26. Preferably, the aperture 80 is generally located in the center of the resilient sanding block 10. Preferably, the primary channels 42-56 (see also FIG. 3) are in communication with the aperture 80. A vacuum source (not shown) is operatively connected to the aperture 80 by means of a vacuum hose (not shown) having a nozzle or end that may be inserted into the aperture 80. As will be understood, when the first or second major surface is in contact with a working surface, the working surface substantially covers the channels so as to form temporary conduits. It will be further understood that the vacuum force will be transferred into the temporary conduits. A vacuum force can also be directed to the aperture 80 by use of a holder (see, for example, FIG. 5) or by attachment of the vacuum source (not shown) directly to the aperture 80.

The channels 42-74 can be formed, molded or cut into the core 12 and are recessed just below the first major surface 24 or the second major surface 26 of the core 12 to allow air to be sucked into the channels 42-74 from outside the core 12 and into the aperture 80. As better illustrated in FIG. 8, air, bringing the dust with it, then travels through the holder 202 and into the vacuum attachment 340 and then into a collection receptacle of a vacuum source (not shown).

Referring particularly now to FIG. 1, in this embodiment, the channels 42-74 form a pattern or grid. The secondary channels 60-74 outline the resilient block 10 while the primary channels 42-56 extend in a radial pattern from the aperture 80. In this embodiment, the channel pattern allows all channels 42-74 to be interconnected with each other and with the aperture 80 thereby distributing the vacuum force to all the channels 42-74. Although the arrangement of channels 42-74 described here is the preferred embodiment, the invention should not be limited to this channel configuration but could include any channel configuration or pattern that serves the purpose of collecting dust while abrading a surface and is similar in concept. Moreover, the particular configuration of the sanding block need not be limited to a rectangular shape. For example, the resilient sanding block could be circular or triangular. In such cases, it will be understood that the channels will be appropriately configured.

As seen in FIG. 3, a channel pattern can be made with fewer channels than the number of channels in the first major surface 24 as shown in FIG. 1, thereby providing more abrasive material 30*b* on the second major surface 26, without sacrificing the efficiency of the dust channeling capability of the resilient sanding block 10. Although not shown, the channel pattern can consist of any number of channels consisting of vertical, horizontal, diagonal or even curved or nonlinear channels that are formed in the major surfaces.

The channels should not be limited in shape and can have any number of cross-sectional profiles including a "v"-shaped groove, round or flat bottom, square or rectangular. A square or rectangular shaped channel is preferred. More preferably, the channels will have a depth and width of about 0.5 to about 7.0 mm, more preferably 1.0 to about 5.0 mm. It is preferred, although not necessary, that the resilient sanding block be provided with channels in the first major surface 24, as well as the second major surface 24, 26 so that resilient sanding block may be inverted and the first and second major surface 26. Additionally, it is preferred that the apertures have a diameter that is larger than the cross-sectional area of the channels.

The resilient sanding block 10 should also not be limited in the number of surfaces that are coated with abrasive material. For example, the first major surface 24, the second major surface 26, two end surfaces 18, 22, and the side surfaces can be coated with abrasive material and a pattern of channels can be applied to only the first major surface 24. It should be noted that any combination of sides with or without abrasive coating or with or without channels can be included in the scope of the invention and the present invention should not be limited in scope by leaving out any combination. Moreover, it is envisioned that the surfaces of the resilient sanding block may be provided with different grades of abrasive material.

Figure 4:
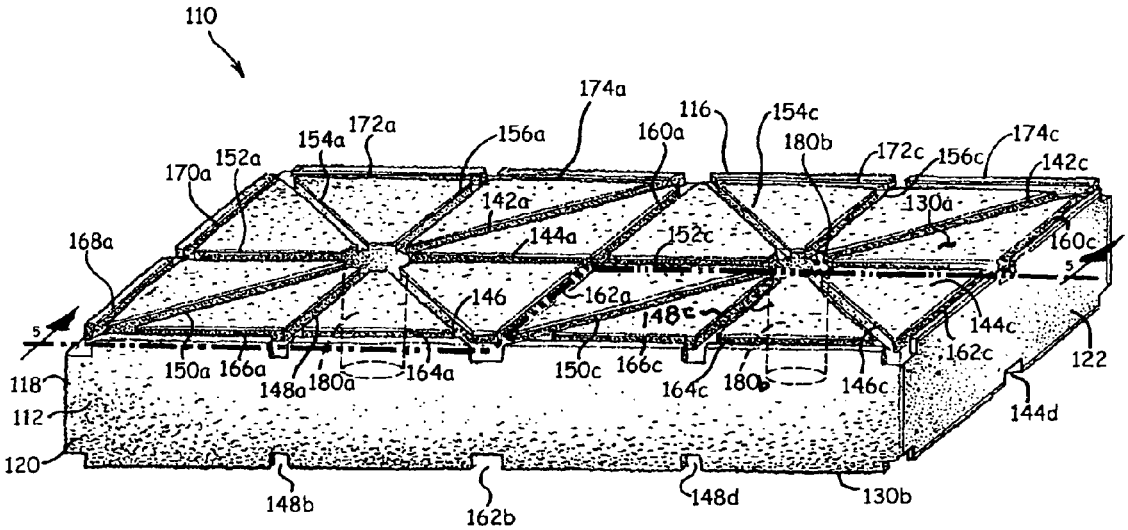
FIG. 4 is a perspective view of another embodiment of the resilient sanding block of the present invention.
Figure 5:
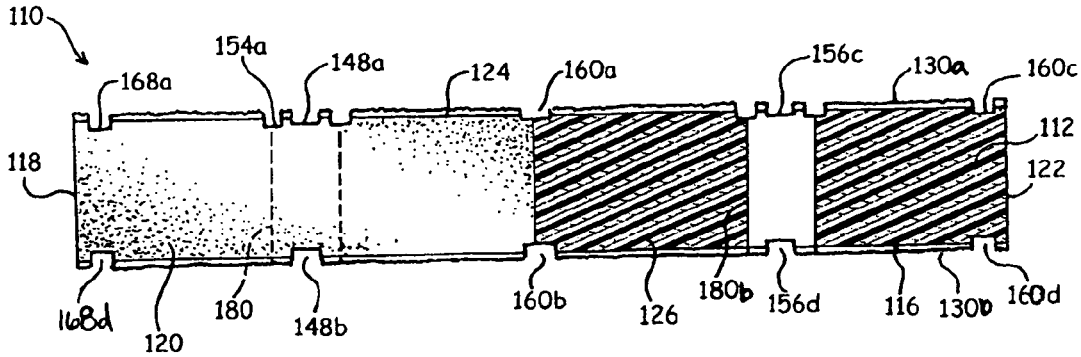
FIG. 5 is a partial side elevational, partial cross-sectional view of resilient sanding block of FIG. 4.

FIGS. 4 and 5 depict another embodiment of the present invention, similar to that shown in FIGS. 1-3. Generally, the resilient sanding block 110 comprises a core 112, major surfaces 124, 126, side surfaces 116, 120, and end surfaces 118, 122. In this embodiment, the resilient block 110 has two apertures 180*a* and 180*b*. Similarly, the resilient sanding block 110 comprises a core 112 having primary channels 142*a*, 142*b* (not shown), 144*a*, 144*b*, 146*a*, 146*b*, 148*a*, 148*b*, 150*a*, 150*b* (not shown), 152*a*, 152*b*, 154*a*, 154*b* (not shown), 156*a*, and 156*b* that are in communication with an aperture 180*a*. The core 112 further comprises secondary channels 160*a*, 160*b*, 162*a*, 162*b*, 164*a*, 164*b*, 166*a*, 166*b*, 168*a*, 168*b*, 170*a*, 170*b* (not shown), 172*a*, 172*b* (not shown), 174*a*, and 174*b* (not shown) that are in communication with the primary channels 142*a*, 142*b*, 144*a*, 144*b*, 146*a*, 146*b*, 148*a*, 148*b*, 152*a*, 152*b*, 154*a*, 154*b*, 156*a*, and 156*b*. Additionally, the core 112 has primary channels 142*c*, 142*d*, 144*c*, 144*d*, 146*c*, 146*d* (not shown), 148*c*, 148*d* (not shown), 150*c*, 150*d* (not shown), 152*c*, 152*d*, 154*c*, 154*d*, 156*c*, and 156*d* that are in communication with an aperture 180*b* and secondary channels 160*c*, 160*d*, 162*c*, 162*d* (not shown), 164*c*, 164*d*, 166*c*, 166*d*, 168*c*, 168*d*, 170*c*, 170*d*, 172*c*, 172*d*, 174*c*, and 174*d* that are in communication with the primary channels 142*c*, 142*d*, 144*c*, 144*d*, 146*c*, 146*d* (not shown), 148*c*, 148*d*, 150*c*, 150*d* (not shown), 152*c*, 152*d*, 154*c*, 154*d*, 156*c*, and 156*d*. Again, the channels are operatively connected to corresponding apertures in a manner similar to the channels shown and described in FIG. 1. Note, however, that some of the channels are in communication with more than one aperture.

Figure 6:
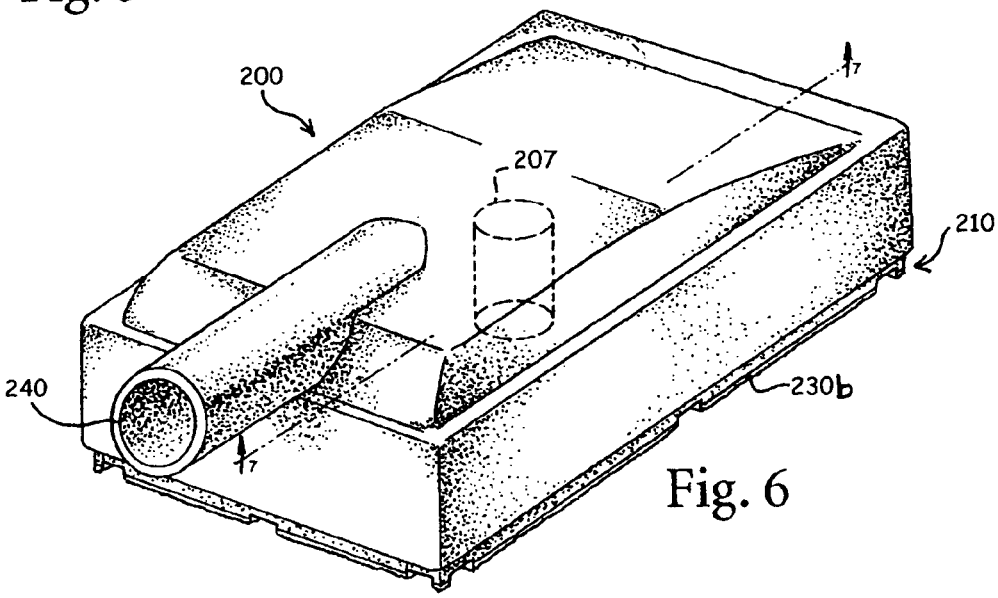
FIG. 6 is an overhead perspective view of one embodiment of a sanding system comprising a resilient sanding block of the present invention in association with a holder.
Figure 7:
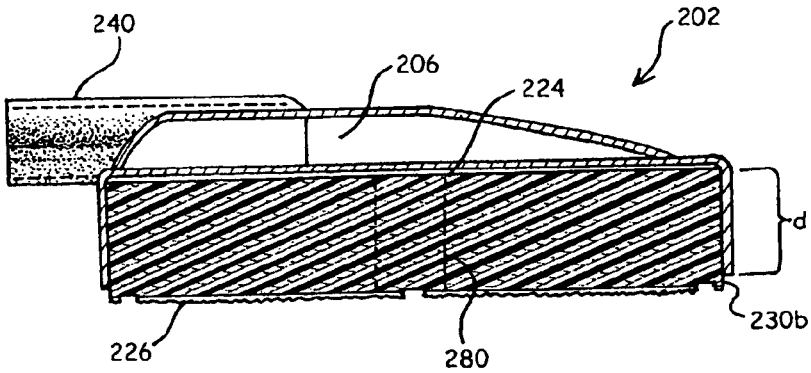
FIG. 7 is a cross-sectional, side elevational view of the sanding system of FIG. 6.

FIGS. 6 and 7 depict a sanding system 200, which is formed by a holder 202 that connects a vacuum source (not shown) and a resilient sanding block 210. The holder 202 further comprises a shell 204 into which a resilient sanding block 210 can be substantially inserted and frictionally retained. The shell 204 has an aperture 207 that allows air to pass from the resilient sanding block 210 via channels and an aperture 280 to a passageway 206 when a vacuum source (not shown) is operatively connected to the sanding system 200 through a vacuum attachment 240 tube. The holder 202 may be of the type presently used with sanding tools.

Figure 8:
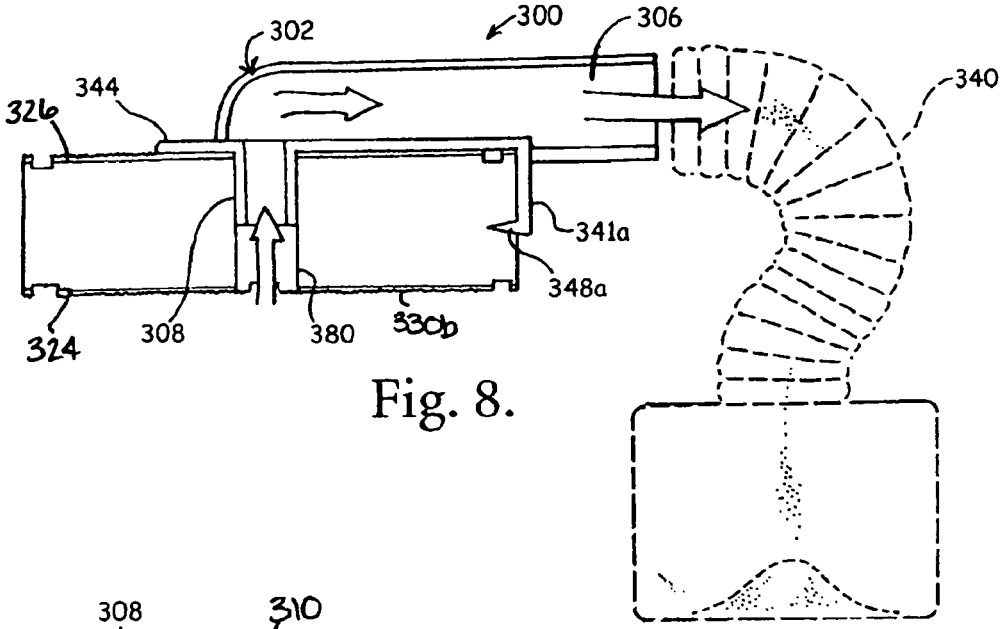
FIG. 8 is a cross-sectional view of another embodiment of a sanding system comprising a resilient sanding block of the present invention in association with an alternatively configured holder.
Figure 9:
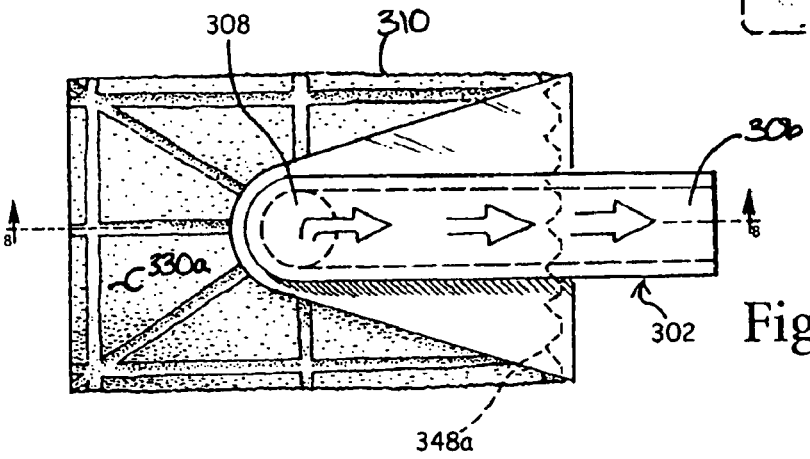
FIG. 9 is a top plan view of the embodiment of FIG. 8.

FIGS. 8 and 9 show an alternate embodiment of a sanding system 300 comprising a holder 302 that connects to a vacuum source (not shown) and a resilient sanding block 310. Here, the holder 302 comprises a passageway 306 defined by a holder 302 that is attached to a triangular plate 244 having a flange 346*a* with block grippers or teeth 348*a* that are angled with respect to the flange 346*a*. A tube 308 is connected to the end of the plate 344. An aperture 307 in the plate 344 allows air to flow between the passageway 306 into the tube 308. The tube 308 is inserted into aperture 380 of the resilient sanding block 310, which allows air to be drawn through channels on the first major surface 324 of the resilient sanding block 310 into the tube 308, through the passageway 306 and into the vacuum source 340.

Figure 10A:
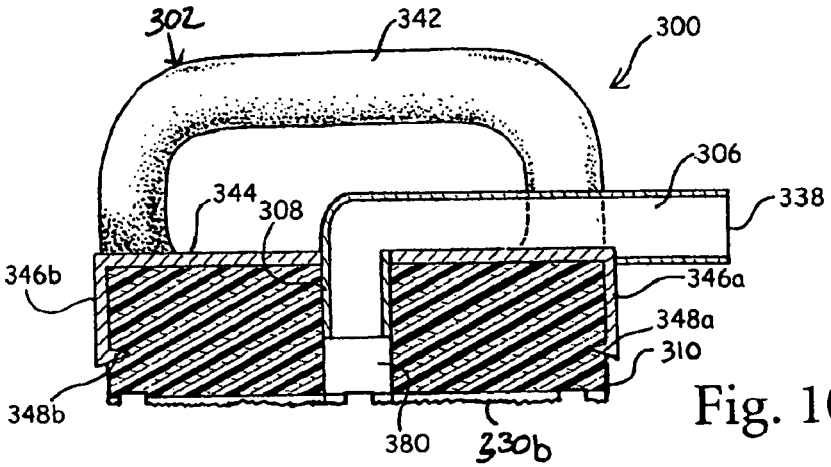
FIG. 10*a* is a cross-sectional, side elevational view of another embodiment of a sanding system that is similar to the sanding system as shown in FIG. 8.
Figure 10B:
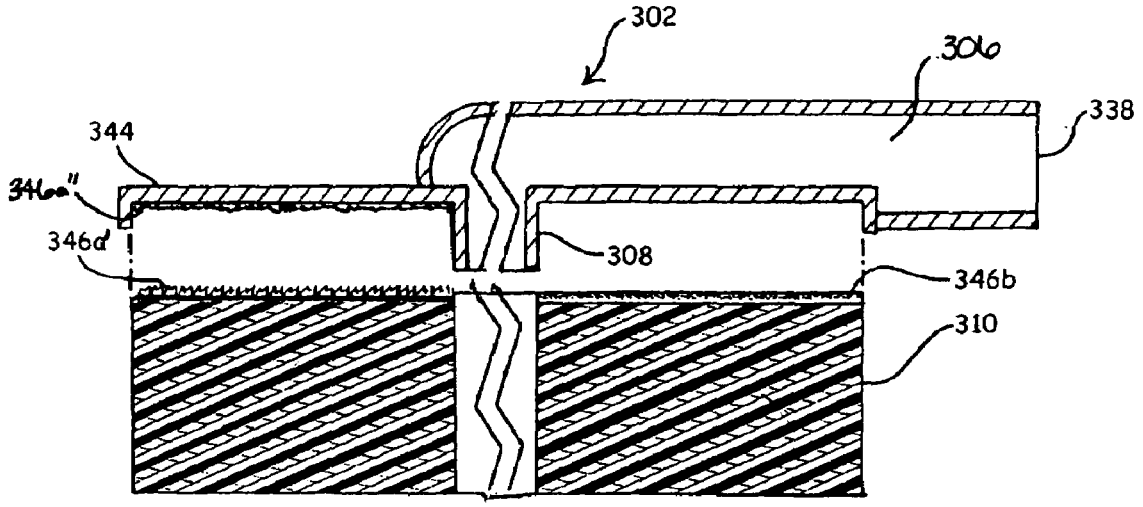
FIG. 10*b* is a side elevational, cross-sectional, split view of alternative methods for attaching a resilient sanding block to a holder.
Figure 11:
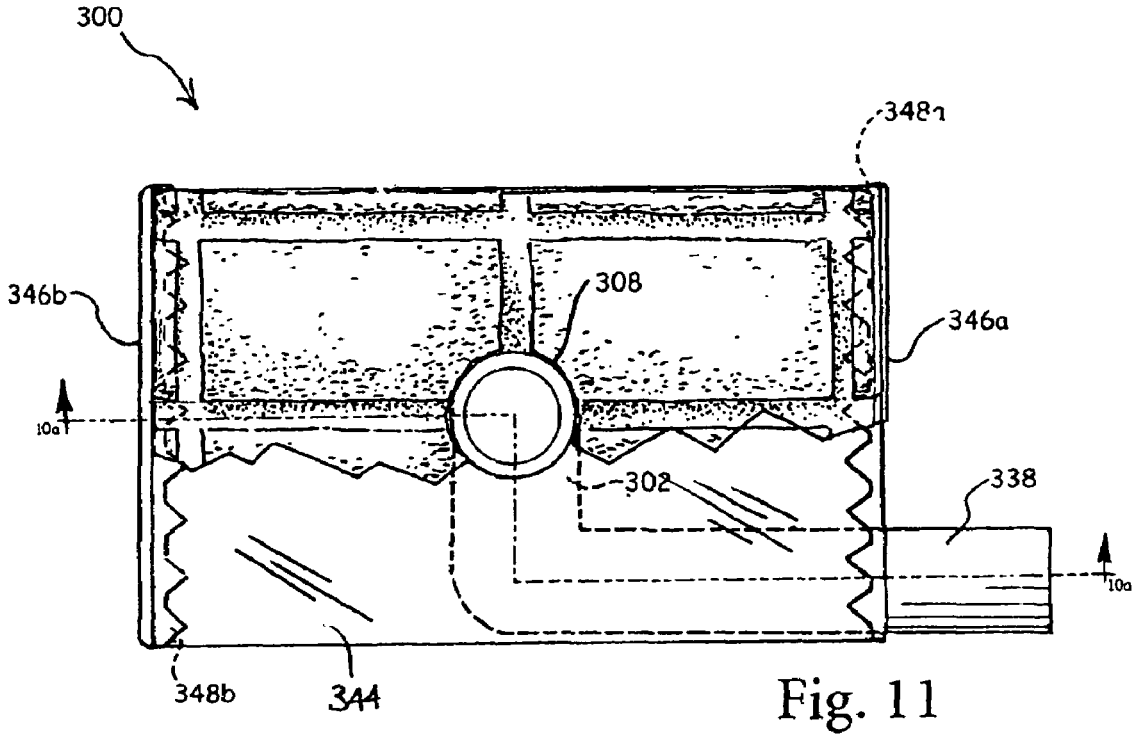
FIG. 11 is a partial bottom plan view of the sanding system of FIG. 10*a* showing portion resilient sanding block in conjunction with the holder of FIG. 10*a;*
Figure 12:
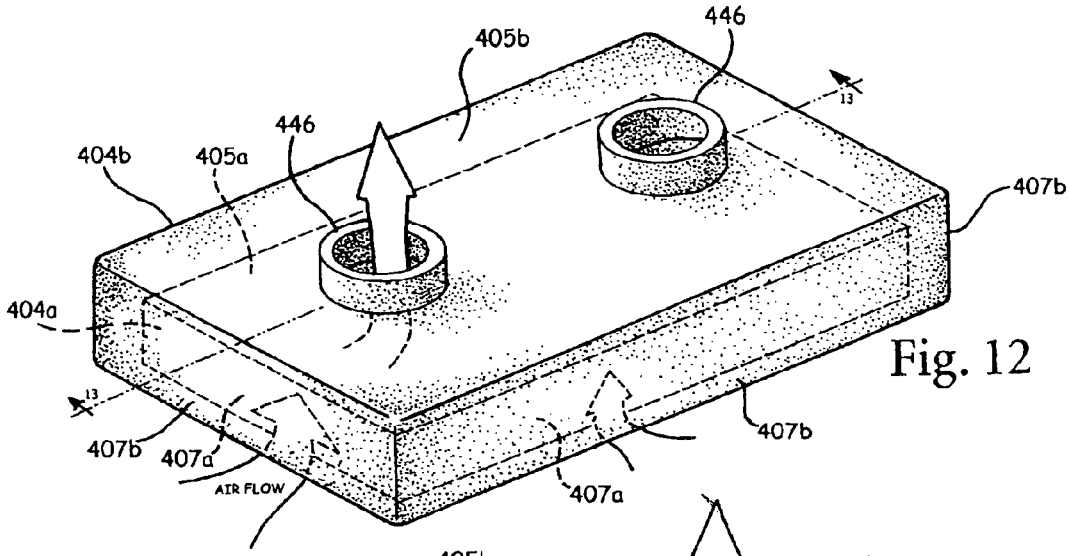
FIG. 12 is an overhead perspective view of an embodiment of a holder of the present invention.
Figure 13:
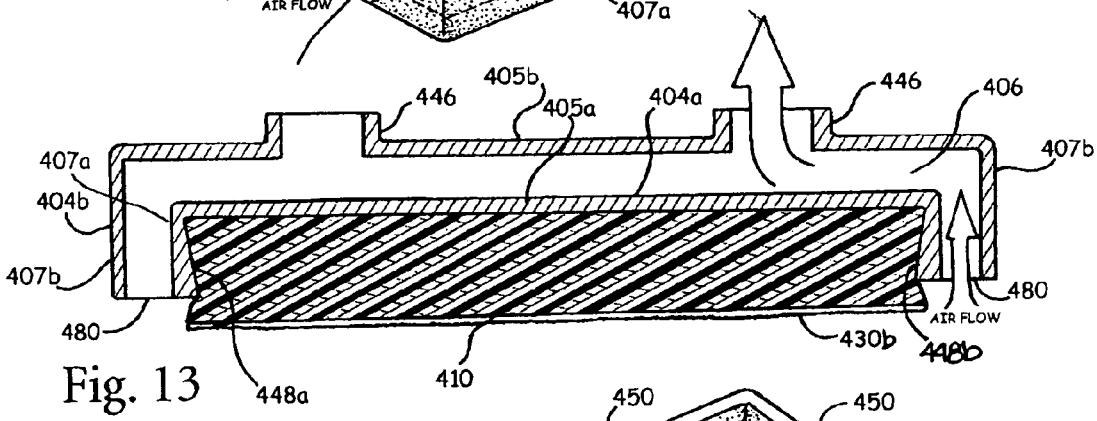
FIG. 13 is a cross-sectional view of the holder of FIG. 12.
Figure 14:
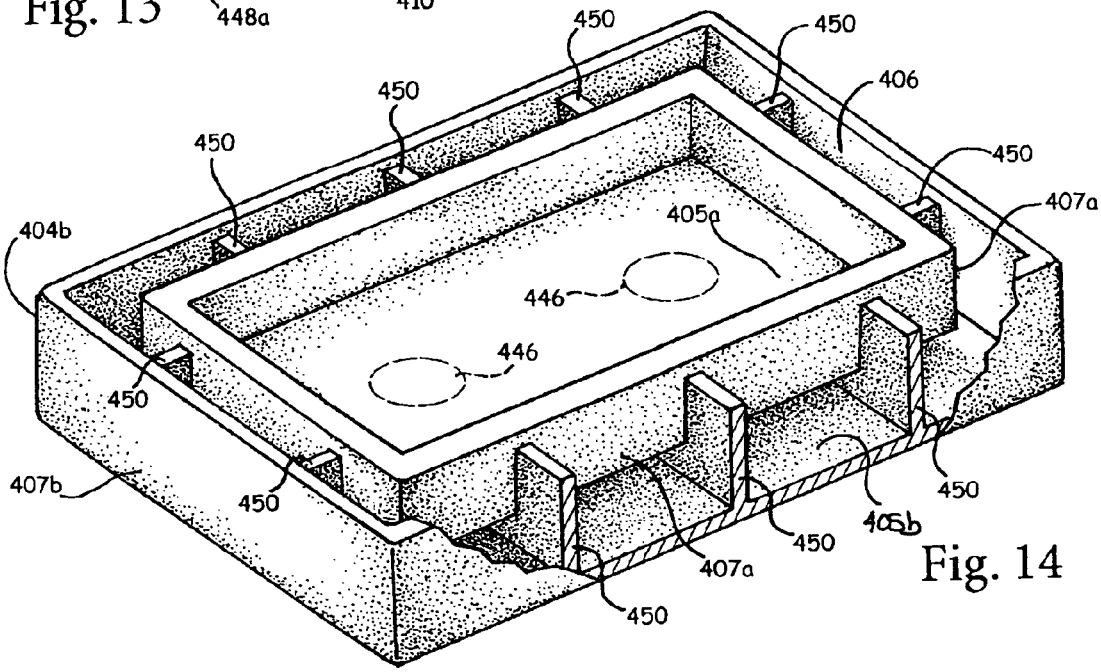
FIG. 14 is an inverted, overhead, perspective, cut-away view of the holder of FIGS. 12 and 13.
Figure 15:
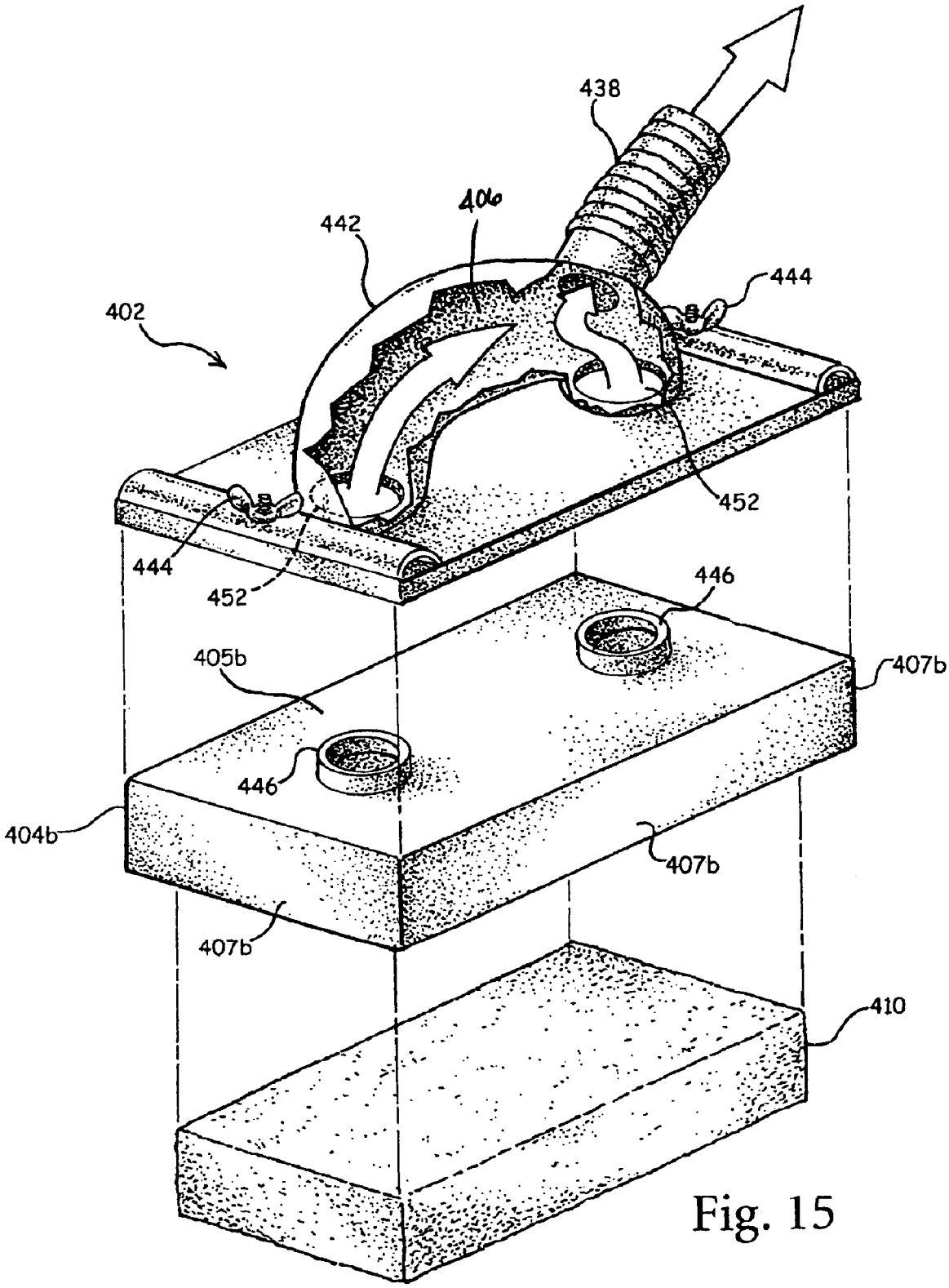
FIG. 15 is an exploded perspective view of a sanding system comprising a resilient sanding block, the holder of FIGS. 12-14, and a handle.

FIGS. 10*a*, 10*b*, and 11 depict alternate embodiments of a holder for a resilient sanding block. Here, the holder 302 comprises a plate 344 that has two downwardly extending flanges 346*a-b* and two sets of teeth 348*a-b* that extend towards each other in a direction that is generally parallel to the plate 344, and, which serve as a means to retain the resilient sanding block 310 in close proximity to the plate 344. Additionally, an optional handle 342 (not shown in FIG. 11) is attached to the plate 344 to provide a better grip for the user. A tube 308 is attached to the holder 302 and extends down from an aperture 307 in the plate 344 and into an aperture 380 in the block 310, with the aperture 380 in communication with channels as previously described. Note that the sanding block 310 does not have channels on both major surfaces.

FIG. 10*b* depicts alternative means for retaining a resilient sanding block in close proximity to the plate 344 of a holder 302. As can be seen on the left side of the figure, hook 346*a*' and loop fasteners 346*a*" may be used. Whereas, on the right side of the figure, adhesives 346*b* may be used.

FIGS. 12-15 show an alternate embodiment of a sanding system 400 comprising a holder 402, a resilient sanding block 410, and a handle 442. The holder 402 comprises a first shell 404*a* and a second shell 404*b*. The first shell 404*a* comprises a top wall 405*a* and side walls 407*a* extending downwardly therefrom, and is configured to frictionally retain a resilient sanding block 410. Note that the side walls 407*a* have wedge-shaped teeth 448*a-b* as to provide a firm grip on the block 410. The second shell 404*b* comprises a top wall 405*b*, a set of side walls 407*b*, and two collars 446. The first shell 404*a* is configured and arranged to substantially reside within the second shell 404*b* in a generally nesting relation, and with the first shell 404*a* connected to the second shell 404*b* such that a passageway 406 is formed between the walls of the first and second shells 405*a-b*, 407*a-b*. Preferably, the first and second shells 404*a-b* are connected to each other by one or more spacers or ribs 450. The passageway 406 allows air/dust to be drawn from around the periphery of the resilient sanding block 410 and to a dust collection receptacle (not shown). As shown, the second shell 404*b* is provided with two collars 446 that line up with the apertures 452 in a handle 442. The collars 446 extend the passageway 406 so that air and dust can flow between the second shell 404*b* and the first shell 404*a* and then ultimately out of the sanding device 400 through the vacuum attachment 438 and in to a collection receptacle (not shown). The collars 446 may be fitted to apertures 452 in the base of the handle 442 to operatively connect the holder 402 to the handle 442. The handle 442 may be of known types presently used in sanding tools and may be attached to the holder 402 with fasteners 444.

Figure 16:
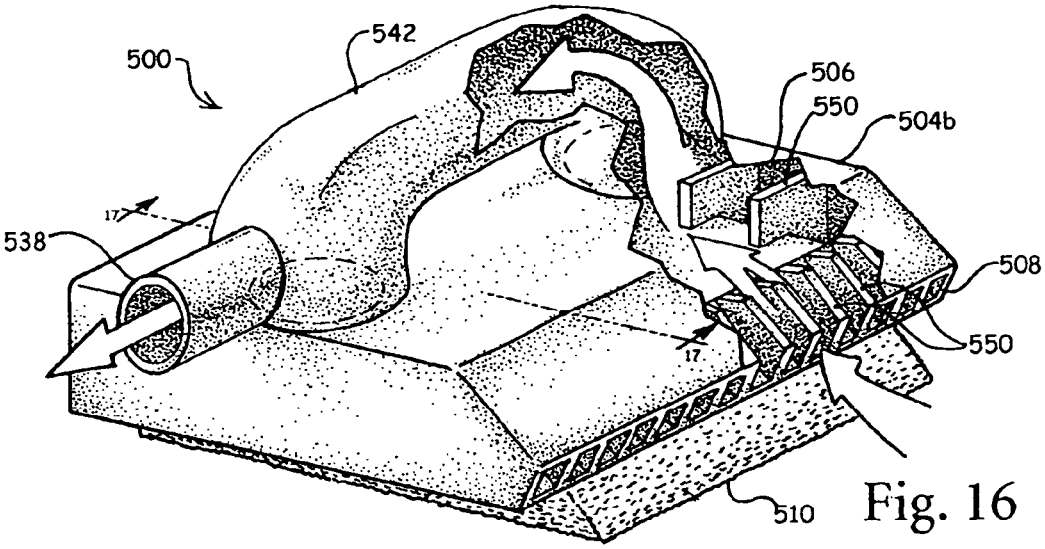
FIG. 16 is an overhead perspective view of another embodiment of a sanding system that is configured to be used with a job-specific resilient sanding block.
Figure 17:
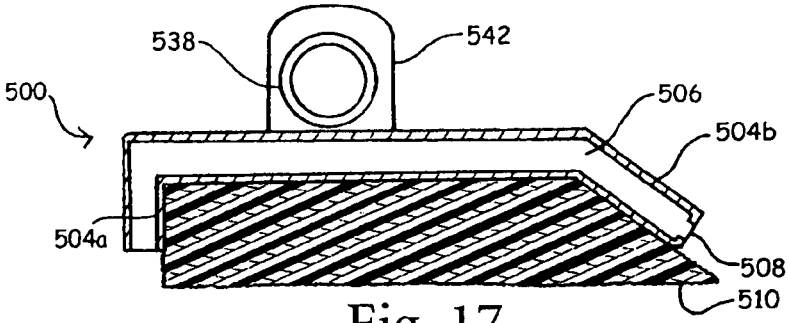
FIG. 17 is a side elevational, cross-sectional view of the sanding system of FIG. 16.
Figure 18:
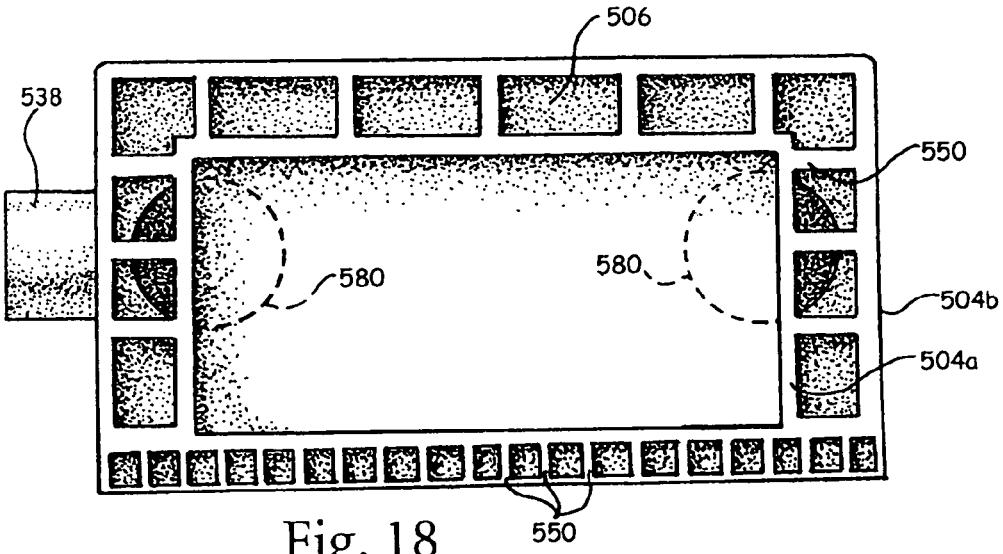
FIG. 18 is a cross-sectional bottom plan view of the sanding system of FIG. 16.

FIGS. 16-18 show an alternate embodiment of a sanding system 500 comprising a holder 502 attached to a resilient sanding block 510 having a similar shape and angle as an angled sanding apparatus commonly used for sanding drywall corners. Generally, this system 500 is similar to the previously described system of FIGS. 12-15 in that it comprises a holder 502 having a first shell 504*a* and a second shell 504*b*. A passageway 506 is formed between the first shell 504*a* and the second shell 504*b* that allows for air/dust to be drawn from around the periphery of the resilient sanding block 510 to a dust collection receptacle (not shown) via a vacuum attachment 540. The first shell 504*a* frictionally retains the resilient sanding block 510. A passageway 506 is formed between the first and second shells 504*a*, 504*b* to facilitate air flow from around the resilient sanding block 510 into the passageway 506 and then into the vacuum attachment 538 and out of the sanding system 500. Preferably, the shells 504*a-b* are connected to one another with spacers or ribs 550 that are positioned at intervals to provide for air to flow between the shells 504*a-b*.

This system 500 differs, however, in that it is designed to work in conjunction with irregularly, job specific angled sanding blocks 510. To that end, the walls of the second shell 504*b* on one side of the holder 502 are angled to reflect the configuration of the block 510. This shifts the passageway 506 on the side of the shell 504*b* so that it is positioned to receive dust that rides up on the angled surface of the sanding block 510. Apertures 508 are located on the side of the second shell 504*b* to allow air/dust to be drawn from around the resilient sanding block 510 into the passageway 506 and eventually out of the sanding system 500 via the vacuum attachment 538.

Figure 19:
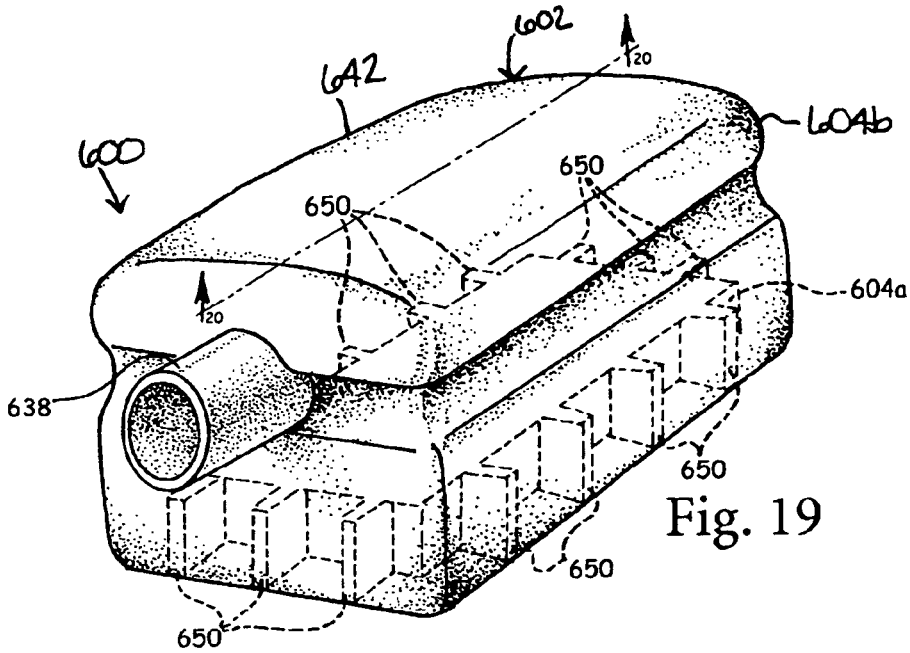
FIG. 19 is an overhead, perspective view of alternative embodiment of a sanding system comprising a resilient sanding block and a holder that functions as a handle.
Figure 20:
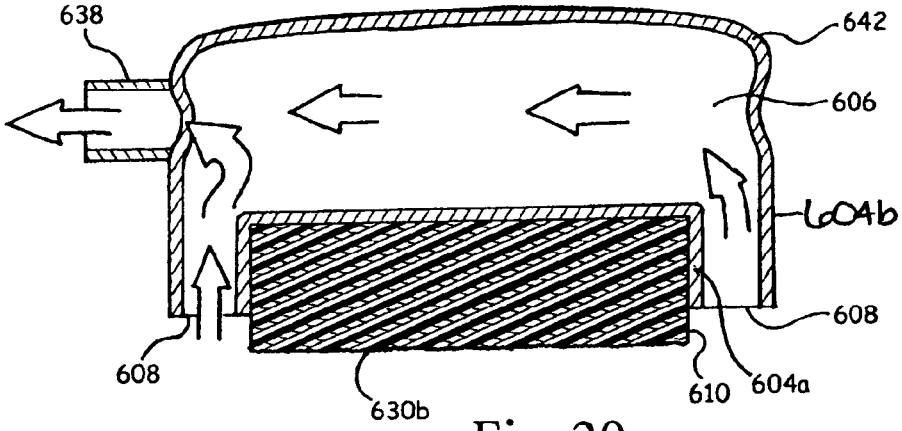
FIG. 20 is a side elevational, cross-sectional view of the sanding system of FIG. 19.
Figure 21:
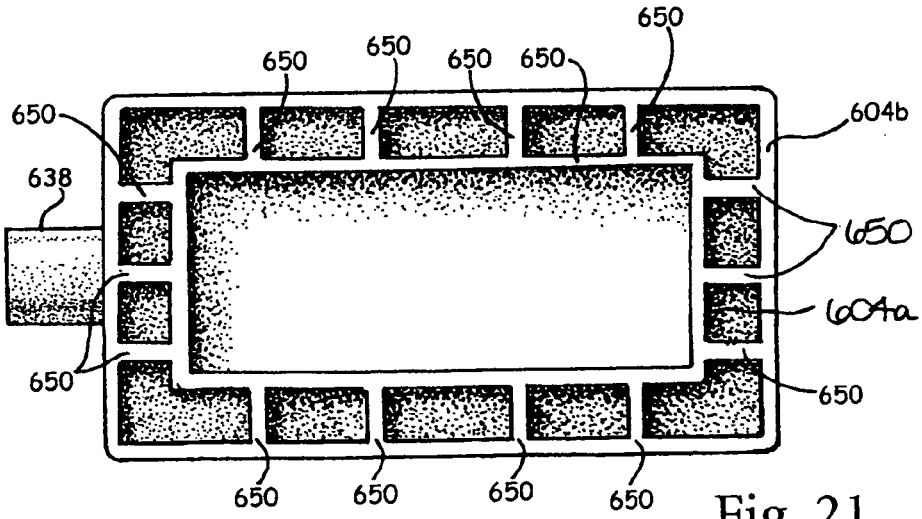
FIG. 21 is a bottom, cross-sectional plan view of the sanding system of FIG. 19.

FIGS. 19, 20 and 21 show an alternative embodiment of a sanding system 600. This system is similar to the previously described system of FIGS. 16-18 in that it comprises a holder 602 having a first shell 604*a* and a second shell 604*b*. A passageway 606 is formed between the first shell 604*a* and the second shell 604*b* that allows for air/dust to be drawn in from around the periphery of the resilient sanding block 610 and directed to a dust collection receptacle (not shown) via a vacuum attachment tube 638. The side walls of the first shell 604*a* may frictionally retain the resilient sanding block 610 whose dimensions may be slightly larger than the interior dimensions of the shell. A passageway 606 is formed between the first and second shells 604*a*, 604*b* to facilitate air flow from around the periphery of the resilient sanding block 610 into the passageway 606 and then into the vacuum attachment tube 638 and onto a collection receptacle (not shown). Preferably, the shells 604*a-b* are connected to one another with spacers or ribs 650 that are positioned at intervals to provide for air to flow between the shells 604*a-b*.

Note that the holder 602 in FIGS. 19-21 does not have the same type of handle as in the previous embodiment. Rather, with this embodiment, the holder 602 further functions as a handle that can be gripped by a user. As will be understood, the particular shape of the holder/handle 602 need not be limited to the particular shape depicted. For example, the handle portion 642 may extend vertically, relative to the longitudinal axis of the sanding block 610.

Figure 22:
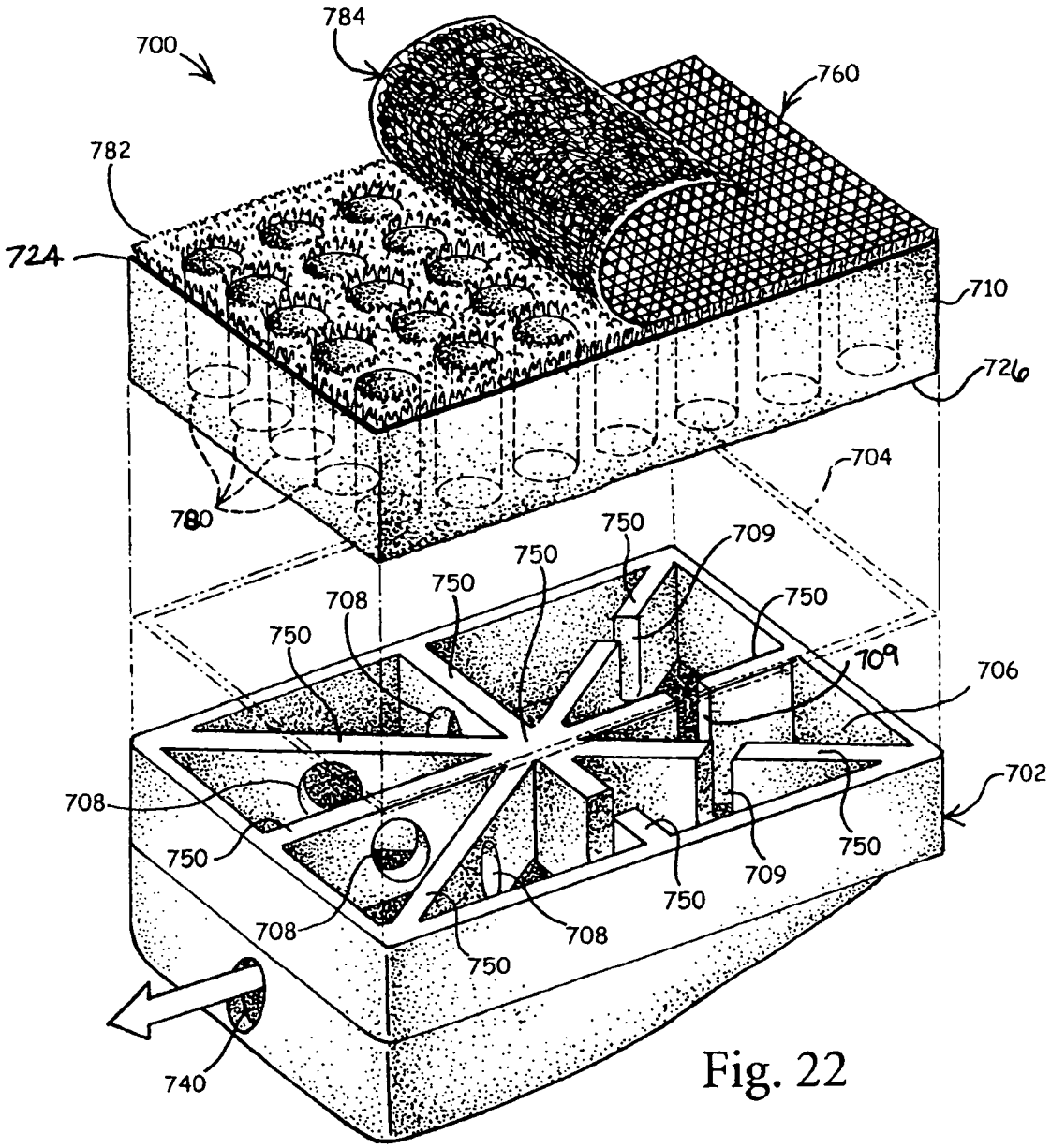
FIG. 22 is an exploded perspective view of another embodiment of a sanding system of the present invention in which an abrasive sheet is attached to a resilient block, and the resilient block us received within a reinforced holder.

FIG. 22 illustrates an alternate embodiment of a sanding system 700, comprising a holder 702 and a resilient block 710. The holder 702 is similar to the holder depicted in FIGS. 6 and 7 in that it has a plurality of side walls that are connected to each other by a top wall. One of the side walls of the holder 702 has an exit port 740. As with the holder of FIGS. 6-7, the holder 702 of this embodiment includes an upper chamber or passageway 706 that is in communication with the exit port 740. This embodiment differs from the embodiment of FIGS. 6-7 in that it is configured to be used with resilient blocks 710 having a plurality of apertures or through holes 780. The holder 702 also comprises a skirt 704 (shown in phantom) that frictionally retains the resilient sanding block 710.

The resilient sanding block 710 of this embodiment also has hook material 782 disposed on a first major surface 724 of the block 710. The hook material 782 may be attached to the surface 724 by laminating a sheet of hook material 782 via adhesive to the first major surface 724 or any other portion of the resilient sanding block 710 in where hook material is desired. The hook material 782 corresponds to a loop material 784 that is attached to an abrasive sheet 760. The abrasive sheet 760 is thereby removably attached to the resilient sanding block 710. The abrasive sheet 760 may be a sanding screen and could be made of a plastic material having the characteristics of a grater. If a sanding screen is used, the sanding screen will preferably have a grit size from about 40 to about 400 grit. The resilient sanding block 710 can be frictionally maintained by a skirt 704 formed by the holder 702.

Inside the holder 702 are support ribs or spacers 750 that serve to position the resilient block 710 away from the passageway 706 so that it partially closes the walls of the holder 702 creating a substantially enclosed passageway 706. Each spacer 750 has an aperture 708 or slot 709 to allow air/dust to therebetween. In operation with an vacuum source, air and or dust will travel from through the abrasive sheet 760, through apertures 780 in the resilient sanding block 710, into the holder 702 and then out of the sanding device 700 through the exit port 740.

Figure 24:
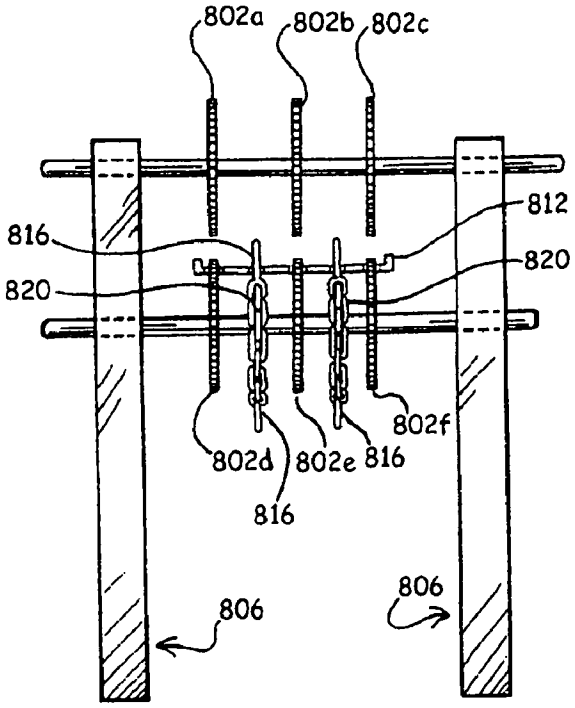
FIG. 24 is a partial, side elevational end view of the machine of in FIG. 23.
Figure 23:
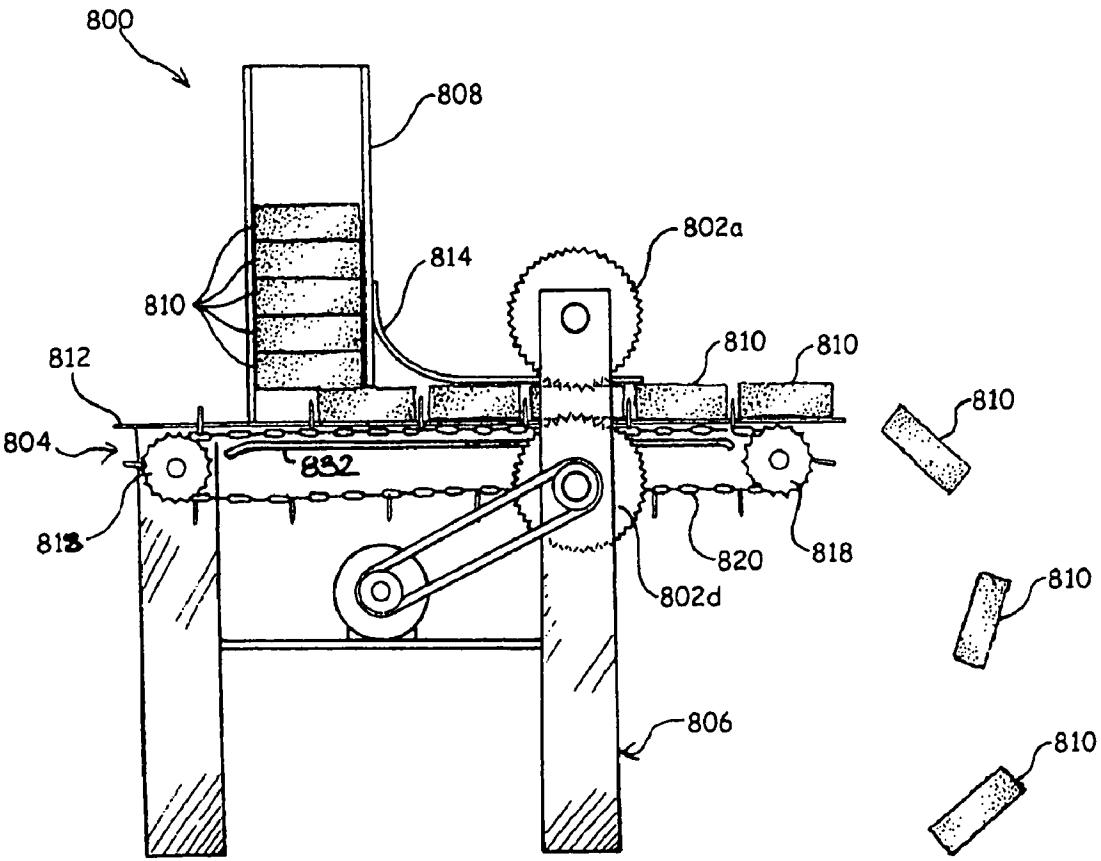
FIG. 23 is side elevational view of an embodiment of a machine used to manufacture the resilient sanding block of the present invention.

FIGS. 23-24 depicts a profile view of a machine 800 designed for forming channels in a resilient sanding block 810. The principle components of the machine 800 are a series of six saw blades 802*a-f*, a chain conveyor system 804, a machine frame 806, a hopper 808, and a slide plate 812. A plurality of resilient sanding blocks 810 are automatically fed into the machine 800 by means of a conveyor system 804 and through a series of saw blades 802*a-f*, three on top and three on bottom, which cut channels into both sides of the resilient sanding block 810 in a single operation.

The conveyor portion 804 of the machine 800 comprises four sprockets 818, two chains 820, and individual catches or tines 816. The chain conveyor system 804 revolves in a clockwise motion around the sprockets 818 so that the catches or tines 816 are able to grab individual resilient sanding blocks 810 from a plurality of blocks 810 stacked in the hopper 808. The resilient sanding blocks 810 fall due to gravity onto the chain conveyor system 804 in-between the tines 816. The chain conveyor system 804 rides on two rails 832 positioned under the slide plate 812. The slide plate 812 has three slots 824 cut into it so that the saw blades 802*a-f* may extend through the slots 824 and above the surface of the slide plate 812, thereby allowing the saw blades 802*a-f* to form channels in the surface of the resilient sanding blocks 810. The slide plate 812 also has two longitudinal slots 824, 826 that cut into the length of the resilient sanding block 810 so that the tines or catches 816 of the chain conveyor system 804 extend above the surface of the slide plate 810 so as to allow the tines 816 to catch or grab resilient sanding blocks 810 from the hopper 808 and push them through the saw blades 802*a-f*. The chain 820, moving clockwise, transports or pushes the resilient sanding blocks 810 through the saw blades 802*a-f*. The saw blades 802*a-f* are set up with a series of three blades on top and three blades on the bottom. The top blades 802*a-c* turn clockwise and the bottom blades 802*d-f* turn counter-clockwise. As the resilient sanding blocks 810 are fed into the saw blades 802*a-f*, a spring bar 814 applies pressure to the top of the resilient sanding block 810 pushing it down onto the slide plate 812 so as to provide enough pressure so the resilient sanding block 810 does not kick up while going through the saw blades 802*a-f*. Adjustable side guides 822 serve to align the resilient sanding blocks 810 accurately through the saw blades 802*a-f* preventing them from wandering from side to side. In the preferred method, the resilient sanding blocks 810 are stacked into the hopper 808 in quantities of about 40 or 50 at a time and gravity fed onto the conveyor 804 and as the conveyor 804 turns the bottom most resilient sanding block 810 is pulled from the bottom of the stack of blocks 810 by the tines 816, which catch the block 810 and push it along and through the saw blades 802*a-f*. The next resilient sanding block 810 falls onto the chain conveyor system 804 on so on. After the resilient sanding blocks 810 are pushed through the saw blades 802*a-f* they will have a series of three saw kerfs or channels (See FIG. 3) cut in one direction on both sides of the resilient sanding block 810.

The set of intersecting channels are cut into the resilient sanding block 810 by the same machine 800 by adjusting the saw blades 802*a-f*, the hopper 808 size and the side guides 822 accordingly and by turning the blocks 810 approximately 90 degrees and restacking them in the hopper 808. Alternatively, the channels may be molded, incised, or heat formed in the resilient sanding block 810.

It is envisioned that, it may be more efficient to have a separate machine of the same type as the machine 800 set up to cut the intersecting channels so the resilient sanding blocks 810 may be placed in hopper 808 of the second machine 800 after going through the first machine 800 without requiring any readjustments. It may also be possible to set up the two machines 800 (only one is shown) so that the chain conveyor system 804 automatically feeds the resilient sanding blocks onto the conveyor system of the second machine without the need to place the resilient sanding blocks 810 in the hopper of the second machine (not shown). It may be necessary to install a cooling system (not shown) to run water on the saw blades 802*a-f* so that they do not overheat from cutting the abrasive material on the resilient sanding blocks 810. In a third operation, the resilient sanding blocks 810 would be taken to a punch machine (not shown) with single or multiple hole punches so that the aperture 80 or apertures (See FIGS. 1 and 4, for example) may be punched into the resilient sanding block by means of existing hole punch mechanisms or machines.

Figure 25:
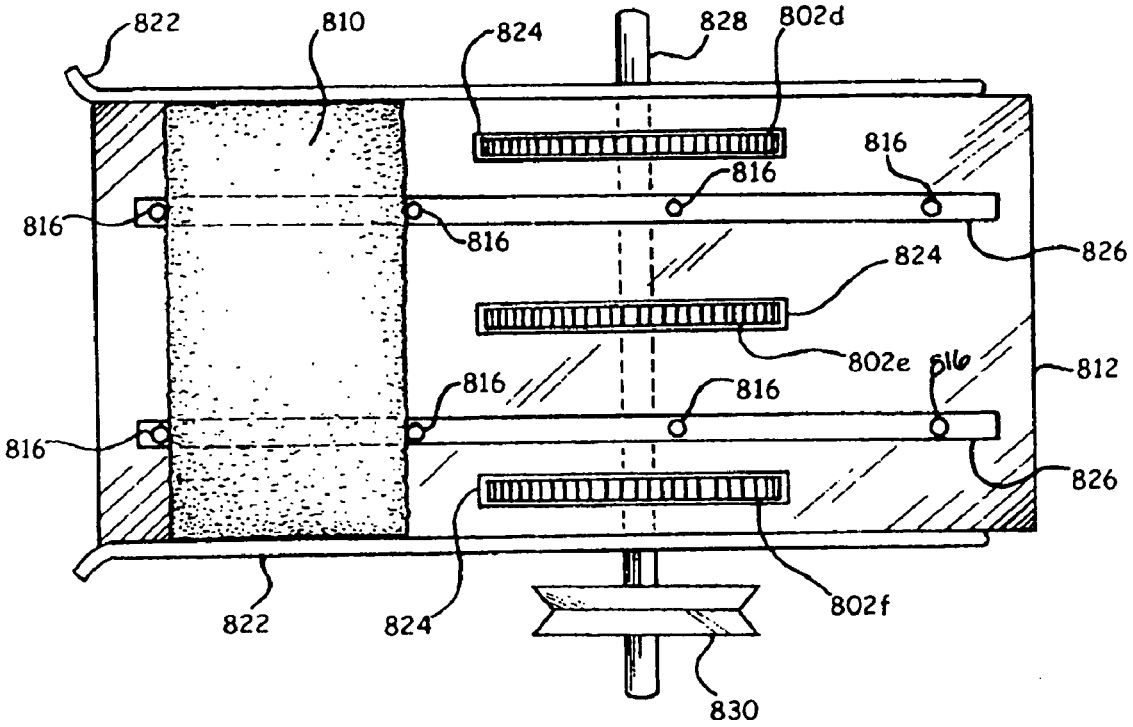
FIG. 25 is a partial top view of the machine of FIG. 23 with the upper blades removed for clarity.

FIG. 25 shows a top view of the machine 800 in FIGS. 23-24 illustrating the principle components of the machine 800 including three saw blades 802*d-f* located underneath the slide plate 812. The blades are positioned on a rotatable shaft 828. The slide plate 812 has three rectangular slots 824 that allow the saw blades 802*d-f* to extend up through the surface of the slide plate 812. The slide plate 812 has two longitudinal slots 826 that allow the tines or catches 816 to extend above the surface of the slide plate 812 so that the tines 816 may grab the individual resilient sanding blocks 810 and push them through the saw blades 82*d-f*. The side guides 822 align and guide the resilient sanding blocks 810 through the saw blades 802*d-f* accurately and prevent side to side movement of the resilient sanding blocks 810. A pulley 830 is attached to the shaft 828 to provide a means of driving the saw blades 802*d-f* by motor and belt (not shown). FIG. 25 does not depict the three saw blades 802*a-c* located above the slide table 812 as shown in FIG. 23 for ease in depicting the principle components of the machine 800.

Although the preferred embodiments and methods of the present invention have been described herein, the above description is merely illustrative. Further modification of the invention herein disclosed will occur to those skilled in the respective arts and all such modifications are deemed to be within the scope of the invention as defined by the appended claims.

What is claimed is:

1. An improved sanding block comprising:

a flexible resilient core having a plurality of exterior surfaces, including an abrasive first major surface and a second major surface and side surfaces;

abrasive material coated onto at least the abrasive first major surface;

at least one aperture extending from the abrasive first major surface to the second major surface; and at least one primary channel having a cross-sectional area, the at least one primary channel being formed in at least the abrasive first major surface, wherein the cross-sectional area of the at least one primary channel is recessed below the abrasive first major surface and wherein the at least one channel extends from one side surface to the at least one aperture whereby the at least one primary channel is in communication with the at least one aperture.

2. The improved resilient sanding block of claim 1, wherein the second major surface is abrasive and further comprises abrasive material coated onto the abrasive second major surface.

3. The improved resilient sanding block of claim 2, wherein the abrasive second major surface has at least one primary channel formed in the abrasive second major surface and having a cross-sectional area, wherein the cross-sectional area of the at least one primary channel is recessed below the abrasive second major surface and with the at least one primary channel extending from one of the side surfaces to the aperture whereby the at least one primary channel is in communication with the aperture.

4. The improved sanding block of claim 1 further comprising a second aperture extending from the abrasive first major surface to the second major surface, wherein the second aperture is spaced from and generally parallel with the first aperture.

5. The improved resilient sanding block of either claim 1 or 3 wherein the at least one primary channel is generally linear.

6. The improved sanding block of either claim 1 or 3 wherein the at least one primary channel has a width in the range of about 1 to about 5 mm.

7. The improved sanding block of either claim 1 or 3 wherein the at least one primary channel has a depth in the range of about 1 to about 5 mm.

8. The improved sanding block of claim 1, wherein the aperture is generally circular and has a diameter that is larger than the cross-sectional area of the at least one primary channel.

9. The improved sanding block of claim 1, wherein the resilient flexible core is generally rectangular and has a thickness defined by the first and second major surfaces, and wherein the thickness is in the range of about 2 to about 3 cm.

10. The improved sanding block of claim 1, wherein the core comprises resilient foam material.

11. The improved sanding block of claim 1, wherein the resilient sanding block is configured and arranged to be operatively connect to a suction device.

12. The improved sanding block of claim 1, wherein the first and second major surfaces are generally parallel with respect to each other.

13. The improved sanding block of claim 1, further comprising at least one secondary channel having a cross-sectional area, the at least one secondary channel being formed in at least the abrasive first major surface, wherein the cross-sectional area of the at least one secondary channel is recessed below the abrasive first major surface and wherein the at least one secondary channel is in communication with the at least one primary channel and with the at least one aperture.

14. The improved sanding block of claim 3, further comprising at least one secondary channel having a cross-sectional area, the at least one secondary channel being formed in at least the abrasive second major surface, wherein the cross-sectional area of the at least one secondary channel is recessed below the abrasive second major surface and wherein the at least one secondary channel is in communication with the at least one primary channel and with the at least one aperture.

15. A method of forming an improved sanding block, comprising:

providing a flexible resilient core having a plurality of exterior surfaces, including an abrasive first major surface and a second major surface and side surfaces;

coating abrasive material onto at least the abrasive first major surface;

extending at least one aperture from the abrasive first major surface to the second major surface;

forming at least one primary channel in at least the abrasive first major surface, the at least one primary channel having a cross-sectional area;

recessing the cross-sectional area of the at least one primary channel below the abrasive first major surface; and extending the at least one channel from one side surface to the at least one aperture whereby the at least one primary channel is in communication with the at least one aperture.

16. The method of claim 15, further comprising coating abrasive material onto the second major surface.

* * * * *